United States Patent [19]

Schmitt

[11] 4,003,276

[45] Jan. 18, 1977

[54] SLITTER AND DUST COLLECTOR THEREFOR

[75] Inventor: Robert L. Schmitt, Magnolia, N.J.

[73] Assignee: Molins Machine Company, Inc., Camden, N.J.

[22] Filed: Apr. 5, 1976

[21] Appl. No.: 674,017

Related U.S. Application Data

[63] Continuation of Ser. No. 510,208, Sept. 30, 1974, abandoned.

[52] U.S. Cl. ..... 83/100; 83/168; 285/9 M; 15/256.51; 83/24; 83/659

[51] Int. Cl.[2] ..... B26D 7/06

[58] Field of Search ..... 83/11, 12, 24, 100, 83/168, 407–408, 433, 499, 500, 508.3, 552, 659, 169, 425.3, 425.4; 15/256.51, 301, 306 A, 308, 415; 24/DIG. 44, DIG. 53, DIG. 78, DIG. 79, DIG. 80; 285/9 M

[56] References Cited

UNITED STATES PATENTS

| | | | |
|---|---|---|---|
| 3,135,151 | 6/1964 | Link et al. | 83/100 X |
| 3,280,896 | 10/1966 | Goodson et al. | 285/9 M |
| 3,599,518 | 8/1971 | Goettsch | 83/659 X |
| 3,763,748 | 10/1973 | Gallagher | 83/24 X |

FOREIGN PATENTS OR APPLICATIONS

| | | | |
|---|---|---|---|
| 821,490 | 10/1959 | United Kingdom | 15/256.51 |

*Primary Examiner*—Donald R. Schran
*Attorney, Agent, or Firm*—Seidel, Gonda & Goldhammer

[57] ABSTRACT

A slitter having slitting blades juxtaposed to the periphery of a bristle-face anvil roll is provided with a dust collector adjacent the interface between said blades and roll. The dust collector includes a housing having a slot for receiving dust and a manifold chamber. Spaced partitions in the housing provide communication between the manifold chamber and specific portions of said opening.

11 Claims, 4 Drawing Figures

SLITTER AND DUST COLLECTOR THEREFOR

PRIOR APPLICATION

This application is a continuation of application Ser. No. 510,208 on Slitter and Dust Collector Therefor filed Sept. 30, 1974, now abandoned.

BACKGROUND

The invention relates generally to a device for collecting air-borne dust generated by slitting of paperboard.

In the manufacture of corrugated paperboard, a web of double face corrugated paperboard is produced. Said web is generally several times wider than the size of the sheet needed to manufacture a blank for a corrugated box. Accordingly, it is general practice to slit the web into two or more ribbons prior to the web being transversely cut to the desired length. The edges of the web may be defective. Hence, it is conventioanl to trim the edges of the web.

The slitter may be provided with three or more rotating blades on a common shaft for slitting the web into desired widths. The blades may have a serrated edge similar to sawteeth and cooperate with a rotary bristle-face anvil roll. The web is slit while being fed over the anvil roll at high speeds. A slitter of this type is disclosed in U.S. Pat. No. 3,508,460 and the disclosure therein is incorporated hereby by reference.

Maximum utilization of a slitter described in said patent has not been achieved because the blades generate an excessive amount of dust. Under some conditions, the dust clings to the paperboard and it interferes with printing of the same. Also, the dust accumulates in the vicinity of the slitter thereby creating a nuisance and a maintenance problem.

Attempts have been made to alleviate the dust problem by using suction nozzles of the type used to remove edge trim. Such nozzles are well known to those skilled in the art. The basic problem inherent in the use of such nozzles is that they must be repositioned to suit each change of position of the slitter knives. In addition, five or six such nozzles must be utilized and adjusted each time the slitter is indexed. The resetting of the nozzles must be accomplished within a few seconds since undue delay of the web of paperboard in the double facer machine, which precedes the slitter in the corrugator line, would cause the web of paperboard to be overheated.

The dust collector includes a housing having an elongated dust inlet opening. The housing includes a manifold chamber. A plurality of partitions having generally parallel straight portions is provided in the housing. Two adjacent partitions communicate at one end with the manifold chamber and at their other end with only a portion of said opening.

The partitions are preferably arranged in the housing in a manner whereby the suction effect at various portions along the length of the opening is substantially uniform.

The dust collector is preferably utilized in a slitter for slitting a web of paperboard and supported so that the opening faces the interface between a plurality of slitting blades on a common shaft and a rotary bristle-face anvil roll.

The apparatus of the present invention overcomes the disadvantages of the prior art by removing dust at the location where it is generated. The dust collector housing has a length which is substantially equal to the length at the brush roll and a substantially uniform suction is created at spaced points along the length of the opening.

Accordingly, a primary object of the invention is to provide a slitter and dust collector therefor.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
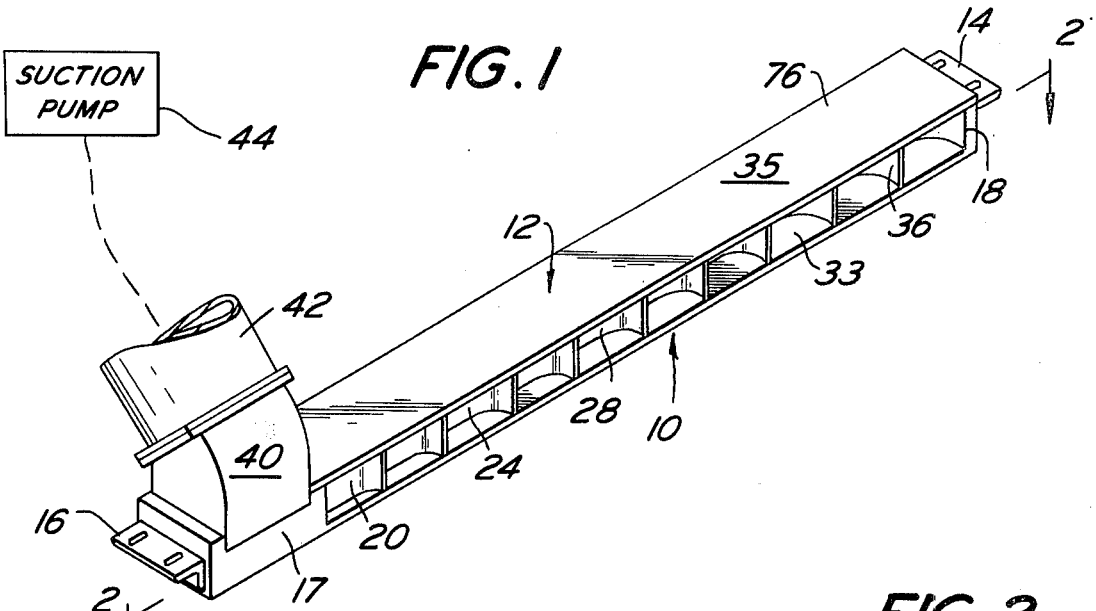
FIG. 1 is a perspective view of a dust collector.

Referring to the drawing in detail, wherein like numerals indicate like elements, there is shown in FIG. 1 a dust collector designated generally as 10. The dust collector 10 includes a housing 12 which is elongated. A bracket 14 is secured to one end of the housing 12 to facilitate mounting the same on a slitter. A similar bracket 16 is secured to the housing 12 at the opposite end.

The housing 12 has a rear wall 15 which is imperforate.

The front wall 17 of the housing 12 is provided with an elongated slot or opening 18 extending for substantially the entire length thereof. A plurality of generally parallel partitions 20, 22, 24, 26, 28, 30, 32, 34 and 36 is provided within the housing 12. Each partition 20–36 has a curved portion at one end which terminates at the slot 18 and a straight portion. The straight portion of the partitions extends to or toward a manifold chamber 38 within the housing 12.

Figure 2:
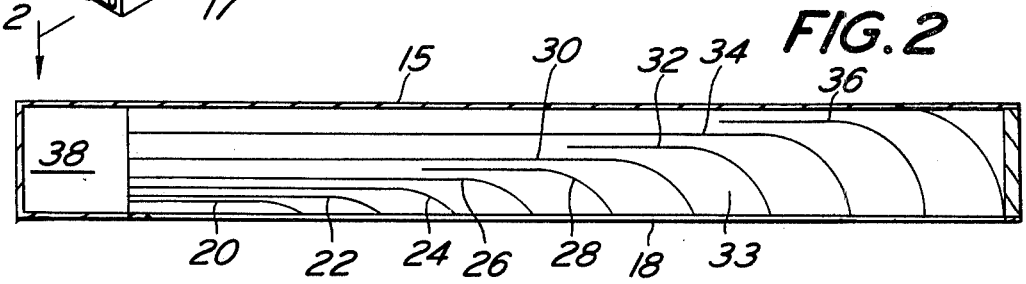
FIG. 2 is a sectional view taken along the line 2—2 in FIG. 1.

It will be noted that partitions 28, 32 and 36 are shorter than the adjacent partitions. Further, it will be noted that the distance between straight portions on adjacent partitions increases in a direction from the front wall 17 toward the rear wall 15. Each partition extends upwardly from the bottom wall 33 to a pivotally mounted cover 35. Cover 35 pivots about hinge 37 to provide access to the interior of housing 12 to facilitate periodic maintenance and removal of any accumulated foreign matter. The space between each pair of adjacent partitions communicates the manifold chamber 38 to only a portion of the slot 18. As will be apparent from FIG. 4, the cross sectional area between the straight portions of any two adjacent partitions increases uniformly in a direction from wall 17 toward wall 15. Due to the spacing between adjacent partitions, the suction effect between the right hand ends of partitions 34 and 36 in FIG. 2 will be substantially the same as the suction effect between the right hand end of partitions 20 and 22 in FIG. 2.

The manifold chamber 38 communicates with a source of low pressure air such as suction pump 44 by way of coupling 40 and conduit 42. A portion of conduit 42 adjacent the coupling 40 is flexible. The end of conduit 42 adjacent the coupling 40 terminates in a retainer which is preferably in the form of a magnet 46 adapted to cooperate with a ferrous member 48 on the coupling 40. The magnet 46 and member 48 retain the terminal end of conduit 42 in the position as shown in FIG. 4 whereby conduit 42 communicates with the manifold chamber 38.

Figure 3:
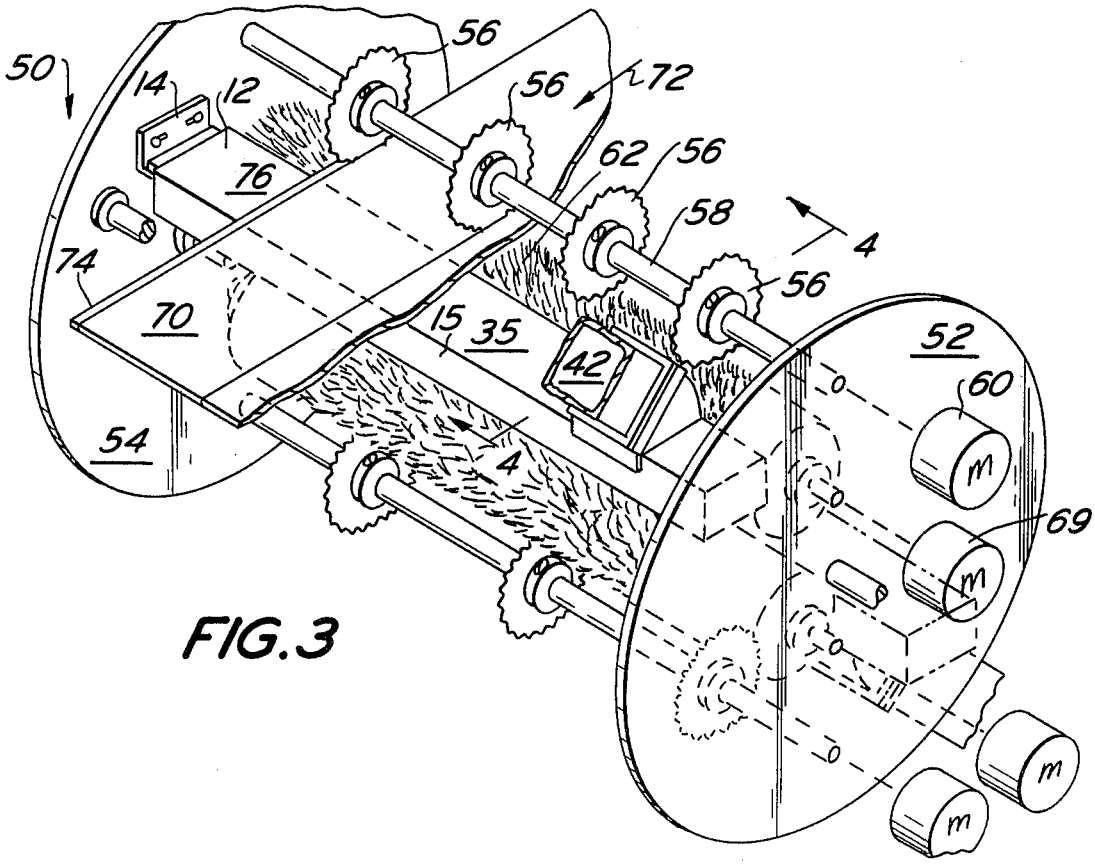
FIG. 3 is a partial perspective view of a slitter incorporating the dust collector shown in FIG. 1.
Figure 4:
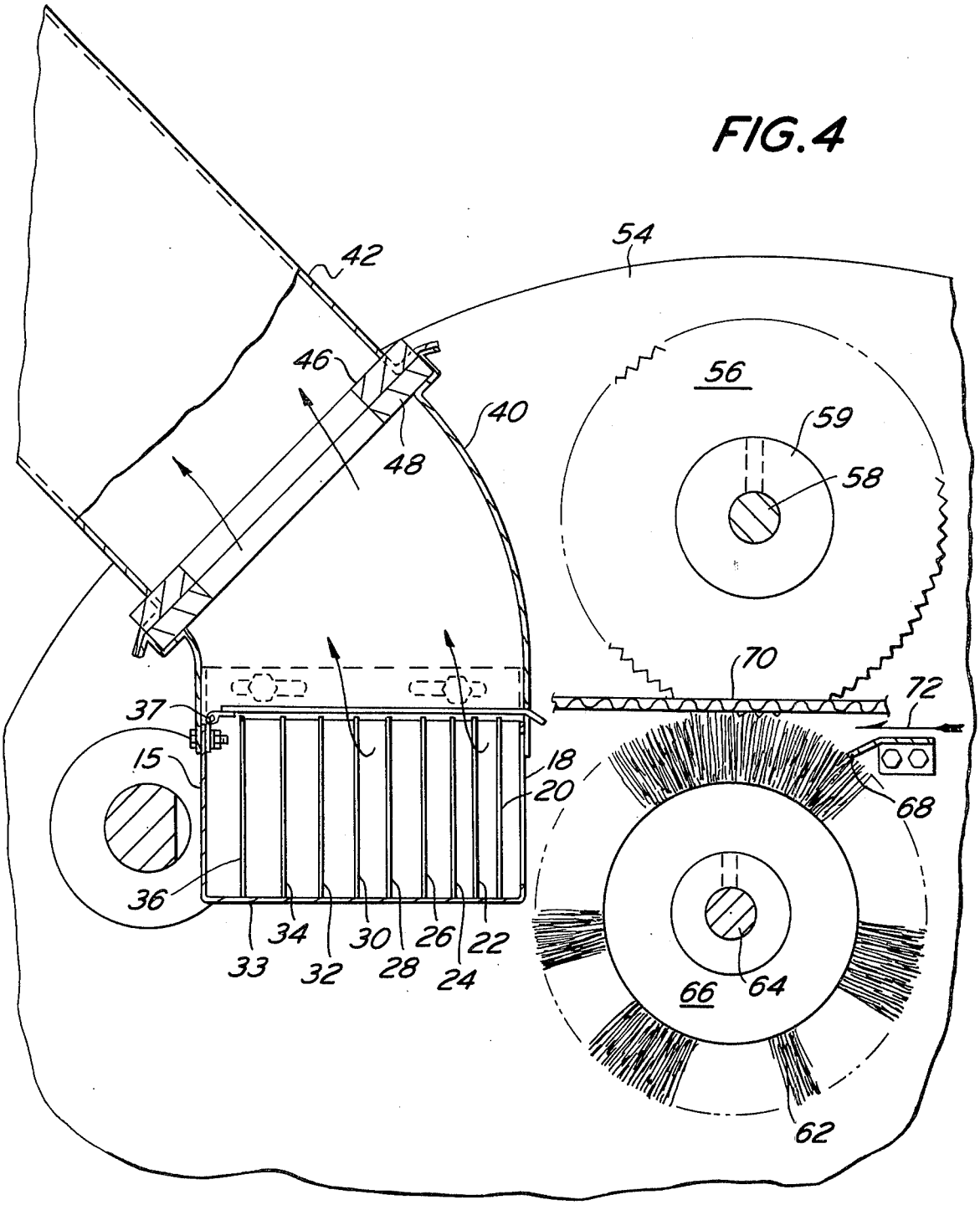
FIG. 4 is a sectional view taken along the line 4—4 in FIG. 3.

In FIGS. 3 and 4, there is shown a slitter 50. The slitter 50 may include frame members 52 and 54 adapted to rotate about a horizontal transverse axis. The frame members 52 and 54 rotatably support one or more sets of slitting blades with a bristle-face anvil roll adjacent each set of blades. Only one such set of blades and anvil roll will be described in detail with its associated dust collector 10.

Referring to FIGS. 3 and 4, a plurality of slitting blades 56 are adjustably mounted on shaft 58. Shaft 58 is rotatably supported at its ends by frame members 52, 54 and driven by motor 60. Each blade is coupled to the shaft 58 by way of a collar 59. Each blade has a serrated peripheral edge for slitting a web of paperboard.

A bristle-face anvil roll 62 is connected to a shaft 64 by way of a collar 66. Roll 62 extends for substantially the full distance between frame members 52 and 54 and hence is longer than the linear distance between the two furthermost blades 56 on shaft 58. The diameter of roll 62 and the distance between shafts 58 and 64 is chosen so that there is a slight interference between the periphery of blades 56 and the periphery of roll 62.

The housing 12 is supported by the frame members 52, 54 so that the slot 18 faces toward the interface between the anvil roll 62 and the blades 56. A doctor bar 68 is supported by the frame members 52, 54 so that it may flex the bristles of the anvil roll 62. One of the frame members 52, 54 supports a motor 69 for rotatably driving the anvil roll 62.

A web 70 of paperboard is adapted to be slit into a plurality of ribbons as it passes between the peripheries of anvil roll 62 and slitting blades 56 in the direction of arrow 72. The outermost of the blades 56 produces a strip of waste trim 74. Motor 60 preferably drives the shaft 58 at a speed so that the peripheral surface speed of the blades 56 is substantially greater than the speed of the web 70. A suitable speed for the blades 56 is 260% of the speed of web 70. Also, motor 69 drives shaft 64 so that the surface speed of the bristles on anvil roll 62 is the same as or slightly greater than the speed of the web 70. I prefer the speed of the anvil roll 62 to be 103% of the speed of the web 70.

All dust generated by the slitting of the web 70, regardless of the position of the blades 56 along the length of the shaft 58, will be removed by way of the dust collector 10. The dust collector 10 presents to the interface between the slitting blades 56 and anvil roll 62 a plurality of passages each having substantially the same suction effect. When it is desired to change the position of the slitting blades 56 along the length of the shaft 58, no adjustments are needed on the dust collector 10.

If the slitter 50 has two or more sets of blades with each set of blades having a cooperating anvil roll, an operator may be adjusting one set of blades for the next production run while the first set is in operation. Thereafter, it is only necessary to rotate the frame members 52 and 54 of the slitter 50 through the predetermined angle so as to present a new set of slitting blades and anvil roll properly positioned for the next production run. When the frame members 52, 54 rotate, the conduit 42 will become separated from the coupling 40 on the previously operative dust collector 10. The magnet 46 will then have to be manually placed in juxtaposition to the ferrous member 48 on the next dust collector 10 before the slitter 50 may commence the production run. Hence, the end of conduit 42 shown in FIG. 4 is adapted to be selectively connected to the coupling 40 on each of the dust collectors 10 of the slitter 50.

It will be noted that the outer surface 76 of cover 35 is planar and that the housing 12 is preferably mounted on the slitter 50 so that surface 76 is parallel to the normal plane of the web 70 and at an elevation so as to serve as a support for the web 70. In this manner the lower surface of the web 70 is adjacent slot 18 where it may be affected by the suction effect and thereby remove any adherent dust.

In an operative embodiment of the present invention, the dust collector 10 would have a length of about 9 feet so that the coupling 40 will be disposed to one side of the web 70 as the web 70 passes through the slitter 50.

The present invention may be embodied in other specific forms without departing from the spirit or essential attributes thereof and, accordingly, reference should be made to the appended claims, rather than to the foregoing specification as indicating the scope of the invention.

I claim:

1. A slitter for slitting a web comprising a frame, a shaft rotatably supported by the frame, a plurality of slitting blades connected to the shaft for rotation therewith and being selectively adjustable to various positions along said shaft, motor means for rotatably driving said shaft, a bristle-face anvil roll generally parallel to and directly below said shaft, the bristles of said anvil roll having an interference fit with each of said blades thereabove, a dust collector supported by said frame downstream from said shaft and being generally parallel to said shaft, said dust collector including a housing having top and bottom walls interconnected with a front wall and a rear wall, said front wall having an elongated dust opening below the elevation of and facing the interface between said blades and anvil roll, a plurality of partitions in said housing, said partitions having a straight portion generally parallel to the plane of said opening, said housing having a manifold chamber adjacent one end, the space between said partitions communicating said manifold chamber with said opening in a manner so that the space between adjacent partitions communicates said manifold chamber with only a portion of said opening, and means supporting said dust collector housing from said frame independent of the support of said anvil roll by said frame.

2. A slitter in accordance with claim 1 wherein said frame is movable and supports a second set of slitting blades juxtaposed to the periphery of a second bristle-face anvil roll, and a second dust collector on said frame and similarly associated with said second blades and anvil roll.

3. A slitter in accordance with claim 1 wherein said dust collector housing includes a planar surface overlying said partitions, said housing being positioned in said frame so that the lower surface of the web may be juxtaposed to and supported by said surface.

4. A slitter in accordance with claim 1 including a conduit connected to a source of suction, said dust collector having a coupling detachably connected to said conduit and communicating with said manifold whereby dust is sucked through said inlet toward the suction source.

5. A slitter in accordance with claim 2 including a source of vacuum and a conduit having one end connected thereto, the other end of said conduit being adjacent said frame for selective connection to the manifold chamber of the housing of each dust collector.

6. A dust collector for use in a slitter for slitting a web comprising an elongated housing having a flat top wall and a vertically disposed front wall, said front wall having an elongated dust inlet opening, said top wall being pivotably connected to said housing about an axis generally parallel to the length of said opening, said housing having a mounting bracket means adjacent each end thereof to facilitate mounting the housing to a frame, a plurality of partitions in said housing, said partitions having a straight portion generally parallel to the plane of said opening, said housing having a manifold chamber therein adjacent one end thereof, a coupling on said housing communicating with said manifold chamber for connecting the manifold chamber to a source of suction, and manifold chamber communicating with said opening by way of the space between said partitions, the space between two partitions communicating at one end with only a portion of said opening, each said portion of said opening being longer than the distance between the straight portions of the associated partitions, and the upper edge of said opening being adjacent to the elevation of said top wall.

7. A dust collector in accordance with claim 6 including a magnetic retainer associated with said coupling for releasably connecting said coupling to a conduit associated with said source of suction.

8. A dust collector in accordance with claim 6 wherein said opening has first and second end portions, said manifold chamber being adjacent said first end portion, the distance between the straight portion of adjacent partitions communicating said manifold with said first end portion of said opening being closer together as compared with the distance between the straight portion of adjacent partitions communicating said manifold chamber with said second end portion of said opening.

9. A dust collector in accordance with claim 6 wherein said housing has a bottom wall, said opening extending from said bottom wall to said top wall.

10. A dust collector in accordance with claim 6 wherein said partitions are curved adjacent said opening, the length of straight portions on some of said partitions being shorter than the length of the straight portions on adjacent partitions.

11. A dust collector in accordance with claim 6 wherein said opening extends between said top and bottom walls, said top wall being flat and adjacent to but slightly below the elevation of a horizontal plane containing said interface.

* * * * *